US005636680A

United States Patent [19]

Mogensen et al.

[11] Patent Number: 5,636,680

[45] Date of Patent: Jun. 10, 1997

[54] METHOD AND DEVICE FOR TERMINATING THE CASTING PROCESS AFTER NON-GRAVITY CASTING OF MOULDS, ESPECIALLY GREEN-SAND MOULDS, PARTICULARLY WITH EASILY OXIDABLE METALS OR METAL ALLOYS

[75] Inventors: Vagn Mogensen, Gentofte; Steen Pedersen, Ballerup, both of Denmark

[73] Assignee: Dansk Industri Syndikat A/S, Herlev, Denmark

[21] Appl. No.: 496,008

[22] Filed: Jun. 28, 1995

[30] Foreign Application Priority Data

Jun. 29, 1994 [DK] Denmark ..... 0776/94

[51] Int. Cl.[6] ..... B22D 37/00

[52] U.S. Cl. ..... 164/66.1; 164/119; 164/136; 164/306

[58] Field of Search ..... 164/66.1, 133, 164/337, 306, 500, 147.1, 259, 119, 136

[56] References Cited

U.S. PATENT DOCUMENTS

| | | | |
|---|---|---|---|
| 2,408,467 | 10/1946 | Lyons | 164/66.1 |
| 3,032,841 | 5/1962 | Sylvester . | |
| 3,114,947 | 12/1963 | Sylvester . | |
| 3,823,760 | 7/1974 | Bloomfield et al. . | |
| 3,880,222 | 4/1975 | Chatourel et al. . | |
| 4,153,100 | 5/1979 | Balevski et al. . | |
| 5,309,975 | 5/1994 | Ohnishi et al. . | |

FOREIGN PATENT DOCUMENTS

| | | |
|---|---|---|
| 0061532 | 12/1981 | European Pat. Off. . |
| 223017 | 10/1985 | European Pat. Off. . |
| 2437734 | 8/1974 | Germany . |
| 3247129 | 6/1984 | Germany . |
| 54-14338 | 2/1979 | Japan . |
| 726355 | 4/1953 | United Kingdom . |
| WO93/11892 | 6/1993 | WIPO . |
| 95/00204 | 5/1995 | WIPO . |
| WO95/18689 | 7/1995 | WIPO . |

*Primary Examiner*—Kuang Y. Lin
*Attorney, Agent, or Firm*—Larson & Taylor

[57] ABSTRACT

After casting a mould (1) through a bottom inlet (2) with liquid metal (4) under pressure through a mouthpiece (5) of a casting device, the inlet (2) is closed by a closing element (8) being pressed by the mouthpiece (5) into sealing abutment against a seat in the mould (1). Subsequently, an inert gas is introduced into a passage (6) in the casting mouthpiece from a source (9) through a pressure reducing valve (11), a shut-off valve (12) which is capable of being selectively opened, a gas chamber (13) and a bore (14) in the mouthpiece (5). The inert gas is introduced such that the casting device can suck the liquid metal (4) from the closing element (8) a distance backwards in the mouthpiece (5). The effect of this is that oxidation of the liquid metal in the mouthpiece (5) or in the nozzle (7) is avoided, and a faster suction of the metal back from the closing element (8) and the nozzle (7) into the passage (6) of the mouthpiece (5), is achieved.

13 Claims, 3 Drawing Sheets

METHOD AND DEVICE FOR TERMINATING THE CASTING PROCESS AFTER NON-GRAVITY CASTING OF MOULDS, ESPECIALLY GREEN-SAND MOULDS, PARTICULARLY WITH EASILY OXIDABLE METALS OR METAL ALLOYS

TECHNICAL FIELD

The present invention relates to a method of terminating the casting process after casting of moulds, especially green-sand moulds and particularly with easily oxidable metals or metal alloys. Moreover, the invention relates to a device for carrying out the method.

BACKGROUND ART

International patent application WO 93/11892 discloses a method and a device for non-gravity casting of moulds. In particular, the patent relates to green-sand moulds in a mould string in a mould-string plant with light metal, in which the metal is pumped by means of an electro-magnetic pump from a holding furnace via a heated ceramic tube through a casting nozzle. The casting nozzle is in sealing abutment with a bottom inlet in the mould and is connected to the mould cavity. After casting the mould, the inlet is closed by means of a displaceable shutter core and the electro-magnetic pump is reversed so that the metal is sucked a distance backwards in the casting nozzle. The casting nozzle may then be removed from the mould and brought into abutment against the inlet of the next mould in the mould string.

Applicants' co-pending international patent application No. PCT DK95/00204 deals with a number of methods of closing the inlet of a mould after casting of moulds in the manner described above.

When the metal is sucked back into the casting nozzle, air is sucked along with it e.g. through the pores in the moulding sand around the inlet of the mould against which the nozzle is in sealing abutment. This takes place rather slowly and thus prolongs the casting process. Also, atmospheric air can bubble up through the metal in the casting nozzle and cause oxidation of the metal, as well as oxidation of the metal surface in the nozzle. Metal can also adhere to the internal surface of the passage in the nozzle. On casting the next mould, metal oxides created in this way may be led into the mould cavity of the mould and be included in the casting thereby reducing the quality of the casting possibly to an extent resulting in its rejection. Moreover, oxides may settle around the opening of the nozzle and prevent the sealing abutment against the next mould of the mould string.

DISCLOSURE OF THE INVENTION

It is the object of the invention to provide a method in which these problems are eliminated, resulting in a fast suction back of the metal in the casting nozzle and avoidance of oxidation of the metal. This object may be achieved by the method in accordance with the present invention. By introducing an inert gas in this way, suction of air into the nozzle during suction back of the metal into the casting nozzle can be avoided. Further, suction back of the metal is faster because the time-consuming suction of air through leaks or pores around the nozzle is unnecessary. At the same time the inert gas prevents any oxidation of the metal and the consequent drawbacks.

In an embodiment of the method according to the invention the inert gas is introduced from a source thereof into a passage in the casting mouthpiece via a gas chamber communicating with said passage. The gas chamber is preferably located above the casting mouthpiece. The connection of the casting mouthpiece with the source of the inert gas is closed after introducing the inert gas into the passage of the casting mouthpiece.

In another embodiment of the method according to the invention the inert gas is introduced into a substantially cylindrical closing element via an opening in the wall of said element and a passage in the mould. The opening in the wall of the closing element, when in the closed position, is aligned with, and communicates with the passage in the mould. The opening of the passage into the outer wall of the mould is connected to a source of inert gas via a gas supply nozzle throughout the process of closing the inlet.

The closing element may be of the kind shown in FIG. 2 or FIG. 4 of the above-mentioned international patent application No. PCT DK95/00204 which is brought into its closing position by advancing the casting mouthpiece of the casting device. The gas supply nozzle may then be moved by said mouthpiece into sealing abutment with the mould around the opening of the passage into the outer wall of the mould.

A method according to the invention of casting moulds wherein the mould cavity is connected to the environment via a single inlet is characterized in that immediately before the mould is completely filled and before closing the inlet of the mould, inert gas is introduced into the inlet system of the mould under such pressure and in such quantity that it partly fills the inlet system.

After closing the inlet, the quantity of gas introduced into the inlet system of the mould will displace liquid metal from the inlet system into the mould cavity. One effect of this is a reduction of the quantity of metal which has to be separated from the solidified casting as return scrap. Also, particularly if the inlet system comprises a feeder, a forced feeding of the casting in a similar way as that described in Applicants' co-pending international patent application No. PCT DK94/00221 may result. Furthermore, the quantity of gas thus enclosed may act as a buffer reducing the pressure peak which results when the mould cavity fills with metal and the movement is suddenly stopped.

The inert gas may be any gas which does not undergo undesirable chemical reactions with, and is not soluble to an appreciable degree in the liquid metal used in the casting process. In general, it is preferred to use argon or nitrogen.

The invention also relates to a device for carrying out the method according to the invention, said device being characterized in that it comprises a source of inert gas under pressure and a conduit communicating with the source, said conduit including a pressure reducing valve and a shut-off valve capable of being selectively opened. The conduit is also connected either to a gas chamber which in turn is connected to a passage in a mouthpiece of a casting device, or to a gas supply nozzle. The gas chamber may be placed above the mouthpiece and connected to the passage of the mouthpiece by a substantially vertical bore in the mouthpiece. The bore may be lined with, surrounded by, or consist of, heat-insulating material.

The gas supply nozzle may be connected by either a rigid connection or an elastic connection to the mouthpiece of the casting device in order to be moved together therewith towards and away from said mould.

BRIEF DESCRIPTION OF THE DRAWINGS

The present invention will be explained in more detail in the following detailed portion of the specification with reference to the drawings, in which.

DESCRIPTION OF THE PREFERRED EMBODIMENT

Figure 1A:
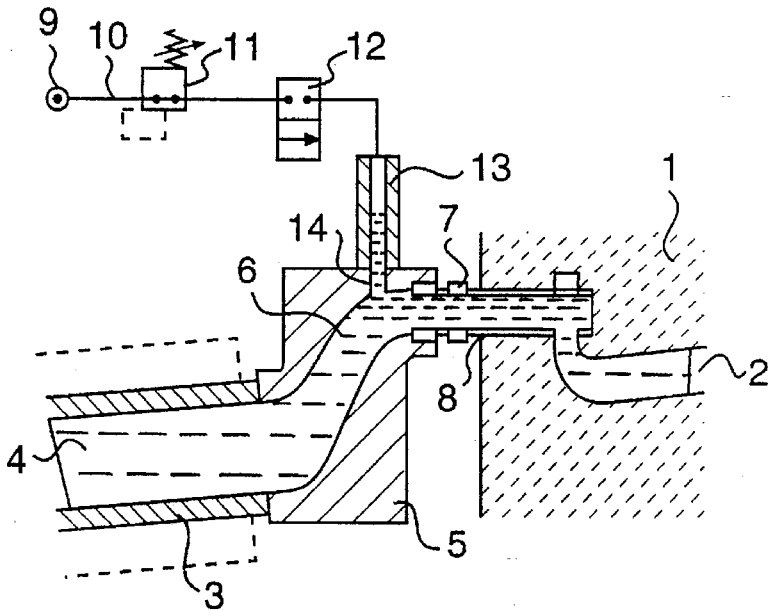
FIGS. 1*a* and 1*b* illustrate a first embodiment of the method according to the invention used in connection with a closing element of a first type.

FIG. 1*a* illustrates a first embodiment of the method according to the invention for terminating the casting of a mould 1, of which only a broken sectional view is shown.

Mould 1 encompasses the inlet 2 of the mould 1, by means of a casting device of the kind disclosed in the international patent application WO 93/11892, of which the Figure shows a broken section of the heated ceramic tube 3. Ceramic tube 3 conveys liquid metal 4 under pressure from the holding furnace (not shown) via an electro-magnetic pump (not shown) to a mouthpiece 5 with an internal passage 6 which is sealingly connected via a nozzle 7 to a hollow, cylindrical closing element 8 of the kind shown in FIG. 2 of international patent application No. PCT DK95/00204. Closing element 8 is also connected to the inlet 2 of the mould 1.

Figure 1B:
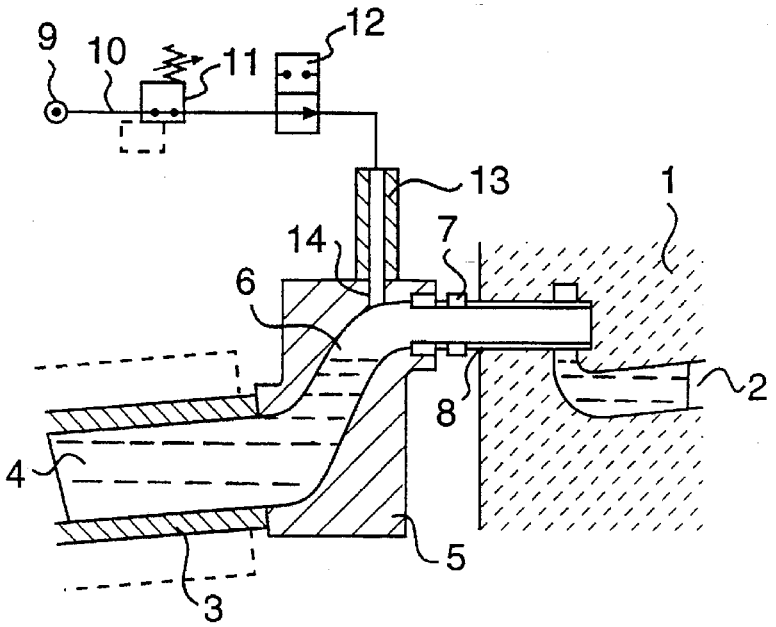

In the situation represented in FIG. 1*b* the inlet 2 of the mould 1 has been closed by the mouthpiece 5 with the nozzle 7 having pressed the closing element 8 inwardly into the mould 1 in such a manner that its internal end is sealingly abutted against a seat (not shown) within the mould 1. Then, from a source 9 of an inert gas under pressure, inert gas has been supplied to a gas chamber 13 via conduit 10, a pressure reducing valve 11 and a shut-off valve 12 which is capable of being selectively opened. The gas chamber is placed above the casting mouthpiece 5 and communicates via a bore 14 with the passage 6 within said mouthpiece. The feeding pressure from the electro-magnetic pump (not shown) of the casting device is adjusted such that the metal 4 from the closing element 8 and the nozzle 7 retracts a distance backwards in the passage 6. Then the shut-off valve 12 is closed. The mouthpiece 5 may now be withdrawn from the mould 1 and brought into contact with a subsequent mould of a mould string in such a manner that the nozzle 7 is placed in sealing abutment against a closing element 8 in said mould.

During the casting of this second mould 1, the same situation as that shown in FIG. 1*a* occurs. More particularly, the pressure of the metal 4 in the passage 6 within the mouthpiece 5 has forced the metal 4 up through the bore 14 and up into the gas chamber 13 during the compression of the inert gas within the chamber 13. It is naturally of importance that this metal does not solidify in the gas chamber 13 during the casting of the mould 1, for which reason the gas chamber 13 may be lined with, surrounded by, or consist of, heat-insulating material.

Figure 2A:
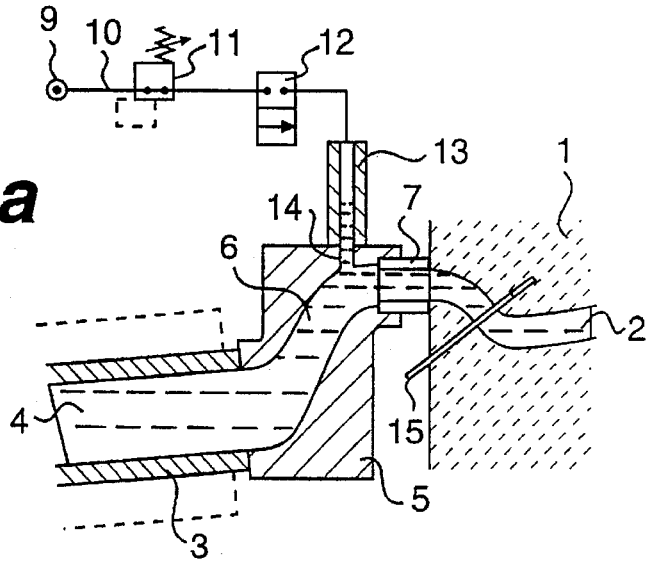
FIGS. 2*a*, 2*b* and 2*c* show the first embodiment of the method according to the invention used in connection with a closing element of a second type.
Figure 2B:
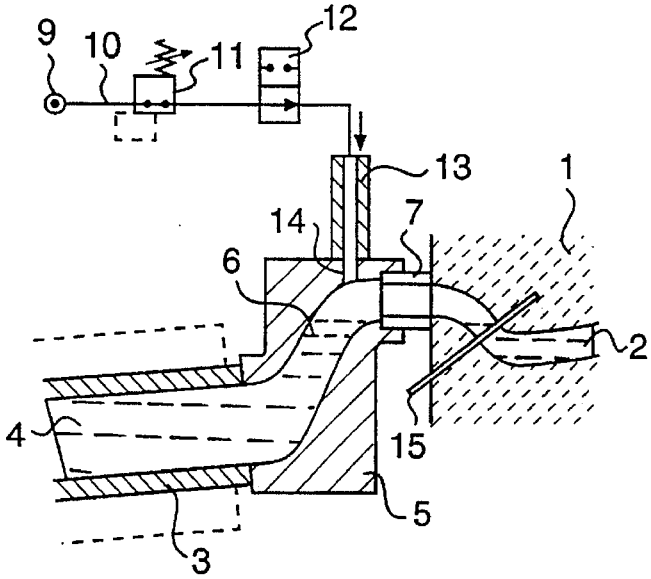
Figure 2C:
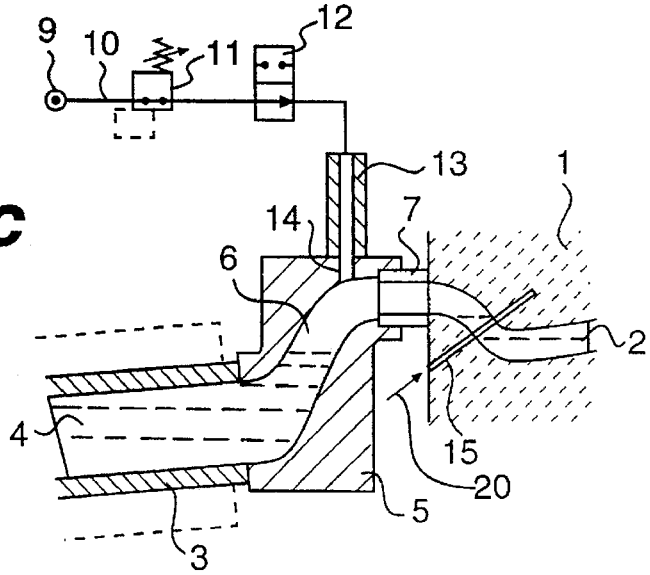

FIGS. 2*a*, 2*b* and 2*c* illustrate a modification of the embodiment of the method according to the invention shown in FIG. 1. In these figures the same reference numerals are used for the same details as in FIG. 1.

FIG. 2 represents the use of a closing element of the kind shown in FIG. 5 of international patent application No. PCT DK95/00204 consisting of a plate 15 being displaceable across an inclined section of the inlet 2 of the mould 1 from a position in which an opening in the plate 15 is aligned with the inclined part of the inlet 2 (FIGS. 2*a* and *b*) to a position in which the inlet 2 is closed by the plate 15 (FIG. 2*c*). At this point the nozzle 7 of the mouthpiece 5 is in sealing abutment against the outer wall of the mould 1 around the opening of the inlet 2. This modification of the embodiment of FIG. 1 does not involve any movement of the mouthpiece 5 towards the mould 1 in order to close the inlet 2 of the mould 1, but only a displacement of the plate 15 in the direction of the arrow 20 shown in FIG. 2*c*.

Another difference from the embodiment of FIG. 1 is shown in FIG. 2*b*. In particular, the inert gas is introduced to the passage 6 immediately before the mould 1 is filled completely, and before the inlet 2 has been closed by means of the plate 15. In the case shown, before complete filling of the mould 1, the metal in the inlet is at the level shown in FIG. 2*b* in the inlet 2. To achieve this, the gas must be introduced under a pressure which is at least as great as the metallostatic pressure in the mould at this level. Then the inlet 2 is closed by displacing the plate 15 in the direction shown by an arrow 20 in FIG. 2*c*, and the electro-magnetic pump is adjusted so that the metal 4 in the passage 6 in the mouthpiece 5 is at the level shown in FIG. 2*c*, after which the shut-off valve 12 is closed. The casting mouthpiece 5 can then be withdrawn from the mould 1.

Both in the embodiment illustrated in FIG. 1 and in the modification thereof illustrated in FIG. 2 it is, however, also possible, immediately before the mould is completely filled and before closing the inlet with the closing elements 8 or 15, to introduce inert gas into the inlet 2 of the mould 1. The inert gas is introduced at the back side of these closing elements 8 and 15 at a pressure which is at least as great as the metallostatic pressure in the inlet 2 and in such a quantity that after closing the inlet 2 by means of the closing elements 8 and 15, respectively, the gas will, by expansion due to the heating in the inlet 2 of the mould 1, at least partially fill up said inlet system. A precondition thereof is, however, that the mould 1 has no other connections to the environment, (e.g. risers) than the inlet 2, as otherwise there is a risk that the expanding gas will penetrate into the mould cavity and cause casting defects in the cast product. By carrying out the method according to the invention as set forth, it could be expedient to include a gasometer (not shown) in the conduit 10 (e.g. between the pressure reducing valve 11 and the shut-off valve 12). The adjustment of the pressure reducing valve 11, the opening and closing of the valve 12 and the closing of the inlet 2 by means of the closing elements 8 and 15, respectively, could then be controlled by a computer on the basis of the gasometer reading and on the basis of data encoded for the mould 1.

In this manner, it is possible to save at least a part of the metal 4 used for filling the inlet system of the mould 1, which metal 4 has to be removed later from the cast product as return scrap, whereby the capacity of the melting furnace is better utilized, and energy which would otherwise be used for melting the metal 4 is saved.

If the inlet system does comprise an outwardly closed feeding reservoir, the expanding inert gas may optionally be used for forced feeding of the castings in a manner similar to that described in international patent application No. PCT DK94/00221.

Figure 3A:
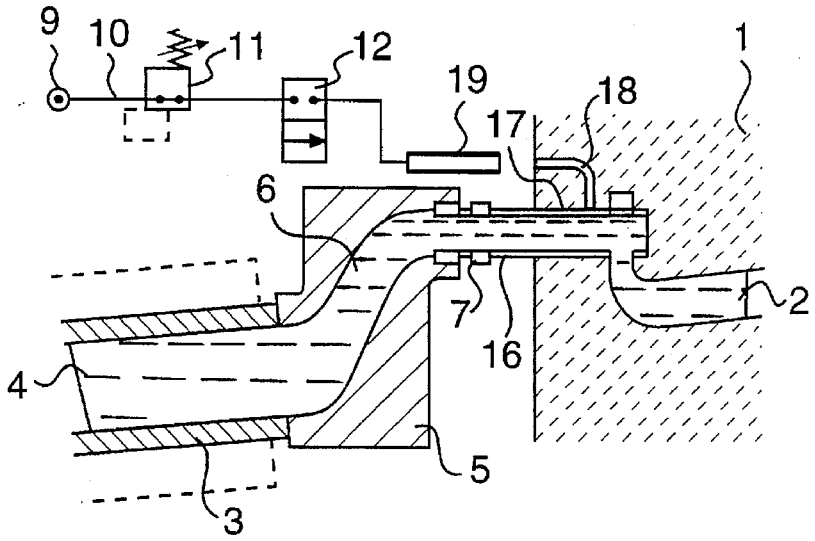
FIGS. 3*a* and 3*b* show a second embodiment of the method according to the invention used in connection with a modified closing element of the first type.
Figure 3B:
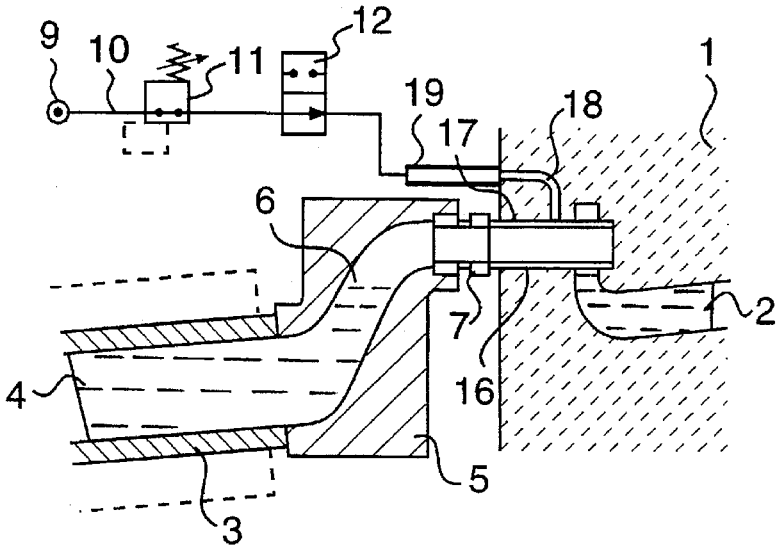

FIGS. 3*a* and 3*b* illustrate another embodiment of the method according to the invention. Details identical with those illustrated in FIGS. 1 and 2 are given the same reference numerals as in those figures.

The closing element 16 of FIGS. 3*a* and 3*b* corresponds to the closing element 8 shown in FIG. 1 with the exception that through its circumferential wall is a through-going opening 17 which, as shown in FIG. 3*b* in the closing position of the closing element 16, is aligned with a passage 18 in the mould 1. In the embodiment shown, the passage 18 opens vertically above the closing element 16 in the outer wall of the mould 1.

The conduit 10, is in this embodiment, connected to a gas supply nozzle 19 which before, during or after closing the inlet 2 in the mould 1 can be brought into sealing abutment around the opening of the passage 18 in the outer mould wall. In this manner, conduit 10 introduces the inert gas through the passage 18 to the interior of the closing element 16 and via the nozzle 7 to the passage 6 in the mouthpiece 5.

The gas supply nozzle 19 is preferably connected to the casting mouthpiece 5 so as to be moved together with the casting mouthpiece 5 either towards or away from the mould 1. This connection may be rigid, but is preferably elastic.

Thus, when the casting mouthpiece 5 is moved towards the mould 1 from the position shown in FIG. 3*a* to the position shown in FIG. 3*b* in order to press the closing element 16 into the closing position shown in FIG. 3*b*, the gas supply nozzle 19 is at the same time moved from its position shown in FIG. 3*a* to sealing abutment around the opening of the passage 18 in the outer mould wall as shown in FIG. 3*b*. The closing element 16 is shown in FIG. 3*b* in the position in which it closes the inlet 2 and in which the opening 17 is in alignment with the passage 18.

In the preceding explanation the invention has been described as it is carried out in connection with a casting device of the kind dealt with in international patent application WO 93/11892. It will be appreciated that the invention may be carried out in connection with other casting devices exhibiting similar characteristics, i.e. which feed liquid metal under pressure to a mouthpiece like the mouthpiece 5 and which after casting a mould like the mould 1 suck the liquid metal a distance backwards in the casting mouthpiece.

We claim:

1. A method of casting and terminating a casting process after bottom fed casting of a mould which includes a mould cavity having a closeable bottom inlet provided with a closing element, and wherein said mould is further provided with a mouthpiece releasably attached to said closeable bottom inlet, said mould cavity being connected to a casting device by a connection located between the mould cavity and the casting device, said method comprising the steps of:

filling the mould cavity of the mould with a metal obtained from the casting device through a closeable bottom inlet via a mouthpiece by applying pressure to the metal to cause it to fill the mould cavity, closing the inlet by means of a closing element after casting the mould, and introducing a pressurized inert gas into the connection between the casting device and the mould cavity immediately before or after closing the inlet, with the pressure applied to the pressurized gas being at least as great as the metallostatic pressure in the mould.

2. A method in accordance with claim 1 wherein the mouthpiece further includes a passage fluidly connected to a gas chamber located above the mouthpiece which, in turn is connected to a source of inert gas, wherein a pressurized inert gas is introduced into the passage in the mouthpiece from the inert gas source via the gas chamber, and further comprising the step of stopping the flow of inert gas from the inert gas source into the passage in the mouthpiece once sufficient inert gas to at least partially fill the inlet of the mould has been introduced to the mouthpiece.

3. A method in accordance with claim 1 wherein the closing element is substantially cylindrical and includes a central passage connected to a passage in the mould and to an opening in a wall of the closing element which, in turn, is connected to a source of inert gas via a supply nozzle, further comprising the step of aligning said opening in the wall of the closing element, when it is in a closed position, with the passage in the mould whereby inert gas can flow from the inert gas source via the opening in the wall of the closing element into the passage in the mould.

4. A method in accordance with claim 3 wherein the supply nozzle is in sealing abutment around the opening of the passage into the mould when the closing element is in the closed position.

5. A method in accordance with claim 1 wherein the mould cavity is connected to an inert gas source as well as a molten metal source via the inlet and further comprising the step of introducing an inert gas into the inlet of the mould, said inert gas being introduced under such pressure and in such quantity that the inert gas at least partially fills the inlet of the mould.

6. A method according to claim 1 wherein the inert gas is selected from the group consisting of argon and nitrogen.

7. A device including a mould and a casting device for terminating a casting process after bottom fed casting of the mould which comprises:

a source of inert gas under pressure, a conduit in fluid communication with the source of inert gas, said conduit including a pressure reducing valve and a shut-off valve which is capable of being selectively opened and closed, a gas chamber fluidly connected to said conduit, the casting device further including a mouthpiece having a passage therein, which passage is fluidly connected to the gas chamber; and wherein the gas chamber is located above the mouthpiece and is fluidly connected to the passage in the mouthpiece by a substantially vertical bore in the mouthpiece.

8. A device as claimed in claim 7 wherein the gas chamber comprises a heat-insulating material.

9. A device as claimed in claim 8 wherein the gas chamber is lined with a heat-insulating material.

10. A device as claimed in claim 7 wherein the gas chamber is surrounded by a heat-insulating material.

11. A casting device for terminating a casting process after bottom fed casting of a mould which comprises:

a mould provided with a mould passage for feeding of metal to the mould, a movable mouthpiece for feeding metal to the mould passage, a source of an inert gas under pressure, a conduit in fluid connection with the source of inert gas at a first end of said conduit, said conduit including a pressure reducing valve and a shut-off valve which is capable of being selectively opened and closed, a gas supply nozzle fluidly connected to a second end of said conduit, and the gas supply nozzle being fluidly connected to the mould passage and connected by a connector to the mouthpiece in a manner which permits the gas supply nozzle to be moved along with the mouthpiece of the casting device to the mould whereby the gas supply nozzle is fluidly connected to the mould passage, and away from the mould whereby the gas supply nozzle is disconnected from the mould passage.

12. A device according to claim 11 wherein the mouthpiece is connected to the gas supply nozzle by a rigid connector.

13. A device according to claim 11 wherein the mouthpiece is connected to the gas supply nozzle by an elastic connector.

* * * * *